US009243430B2

(12) United States Patent
Meyer et al.

(10) Patent No.: US 9,243,430 B2
(45) Date of Patent: Jan. 26, 2016

(54) LOCK FOR A MOTOR VEHICLE DOOR OR HATCH

(75) Inventors: Dieter Meyer, Wolfsburg (DE); Kay-Olaf Loock, Wolfsburg (DE); Kai Schrenke, Walbeck (DE); Marek Dragon, Waldbröl (DE)

(73) Assignee: Kiekert AG, Heiligenhaus (DE)

( * ) Notice: Subject to any disclaimer, the term of this patent is extended or adjusted under 35 U.S.C. 154(b) by 954 days.

(21) Appl. No.: 13/383,639

(22) PCT Filed: Jul. 8, 2010

(86) PCT No.: PCT/DE2010/000790

§ 371 (c)(1),
(2), (4) Date: Mar. 20, 2012

(87) PCT Pub. No.: WO2011/006473

PCT Pub. Date: Jan. 20, 2011

(65) Prior Publication Data

US 2012/0161455 A1 Jun. 28, 2012

(30) Foreign Application Priority Data

Jul. 13, 2009 (DE) ..... 10 2009 032 894

(51) Int. Cl.
*E05C 3/06* (2006.01)
*E05B 77/38* (2014.01)
(Continued)

(52) U.S. Cl.
CPC ..... *E05B 77/38* (2013.01); *E05B 85/26* (2013.01); *E05B 2015/0458* (2013.01); *E05B 2015/0468* (2013.01); *Y10T 292/1051* (2015.04)

(58) Field of Classification Search
CPC . E05B 77/38; E05B 85/26; E05B 2015/0458; E05B 2015/0468; E05B 77/40; E05B 77/42; Y10T 292/1051
USPC ..... 292/219, 216, 201, DIG. 56, DIG. 73, 292/DIG. 60, DIG. 61, 80, DIG. 23
See application file for complete search history.

(56) References Cited

U.S. PATENT DOCUMENTS 6,349,983 B1 * 2/2002 Dupont et al. ..... 292/201
7,306,269 B2 * 12/2007 Cetnar et al. ..... 292/341.12

FOREIGN PATENT DOCUMENTS

DE 2218734 A1 10/1973
DE 38 25 594 A1 7/1988
DE 8915280 U1 2/1990

(Continued)

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

A lock for a motor vehicle door or hatch with a plastic lock housing (2) attached to the vehicle door or hatch, which is provided with a guide slot (6) for a latch bracket (5) or latch bolt and at least one spring lip (8), attached at the entrance side of the guide slot (6) extending longitudinally therein and formed as a single piece with the lock housing, for elastically supporting the latch bracket (5) or latch bolt in the closed position of the lock as well as during insertion of the latch bracket (5) or latch bolt into and retraction of the latch bracket (5) or latch bolt out of the guide slot (6) and the catch (3), and wherein at least one said spring lip (8) at least in a region of its free end, which free end corresponds to an end position and a support position (9) of the latch bracket (5) or latch bolt in the closed position of the lock, includes an overlay (10) having a low-friction, wear-resistant surface.

14 Claims, 2 Drawing Sheets

(51) Int. Cl.
*E05B 85/26* (2014.01)
*E05B 15/04* (2006.01)

(56) References Cited

FOREIGN PATENT DOCUMENTS

| | | | | |
|---|---|---|---|---|
| DE | 44 20 185 | A1 | | 12/1995 |
| DE | 10012750 | A1 | * | 9/2001 |
| DE | 102 16 313 | A1 | | 4/2002 |
| DE | 102 15 691 | A1 | | 1/2003 |
| DE | 103 20 457 | A1 | | 12/2004 |
| DE | 10 2004 031 266 | A1 | | 1/2006 |
| DE | 10 2006 028 423 | A1 | | 12/2007 |
| DE | 20 2007 017 195 | U1 | | 4/2008 |
| DE | 20 2008 012 010 | U1 | | 12/2008 |
| FR | 2 324 837 | A1 | | 4/1977 |
| WO | 2004/101920 | A1 | | 11/2004 |

* cited by examiner

LOCK FOR A MOTOR VEHICLE DOOR OR HATCH

CROSS-REFERENCE TO RELATED APPLICATIONS

This is a National Stage Application of International Patent Application No. PCT/DE2010/000790, with an international filing date of Jul. 8, 2010, which is based on German Patent Application No. 10 2009 032 894.7, filed Jul. 13, 2009.

BACKGROUND OF THE INVENTION

1. Field of the Invention

The invention relates to a lock for a motor vehicle door or hatch according to the combination of features of claim 1.

2. Brief Description of the Related Art

It is known in the art that when a side door is closed and a latch bracket or latch bolt attached to the vehicle body enters the catch of the lock and/or when the latch bracket or latch bolt goes through the various relative orientations with respect to the catch, sounds are produced, which should be avoided for comfort reasons. A variety of solutions are known to reduce the described noise generation.

So it is known, for example, on the one hand to coat the contact areas between the catch and the latch bracket or latch bolt with an elastic damping layer (DE 102 16 313 A1, DE 10 2004 031 266 A1, DE 10 2006 028 423 A1), and on the other hand to provide an additional protective layer on said damping layer, which is not only elastic, but also reduces wear and tear and prevents creaking noises from occurring in the closed position of the lock (DE 10 2006 028 423 A1).

Furthermore, from DE 10 2004 031 266 A1 is known a lock with a catch, which features a lip-like insertion opening for the latch bracket, which is bounded by a support leg and a locking leg. As a result of cooperation between the latch bracket and the support leg, the catch rotates into a closed position, in which a spring-loaded pawl automatically engages with a supporting shoulder of the catch. In the closed position, a spring element tensions the latch bracket against a wall that limits the insertion opening and that is formed by the support leg. The spring element narrows the insertion opening. During the insertion of the locking pin into the insertion opening, the spring element is biased or further biased by the latch bracket.

Moreover, from DE 44 20 185 A1 is known a door lock for a motor vehicle door having a friction brake, comprising a cam at the catch and a leaf spring, which protrudes into the path of movement of the cam shortly before the closed position is reached in order to slow down the pivoting movements of the catch and, accordingly, to avoid operational noises.

Furthermore, from DE 38 25 594 A1 is known a lock for motor vehicle doors or hatches, including a catch cooperating with a vehicle-mounted latch, wherein the catch includes a receiving conduit adapted to receive the latch. To avoid any mutual backlash between the catch and the latch, a leaf-like guide spring is attached at both of its ends to a portion of the catch that lies opposite the front side of the latch in a closed position. The guide spring enters the lower portion of the cross-section of the receiving conduit such that the front side of the latch glides along the guide spring while being acted upon by it.

Additionally, from DE 103 20 457 A1 is known a motor vehicle door lock with a catch, a pawl, and a latch bolt that enters an inlet opening and cooperates with the catch, wherein the inlet opening features at least a damping element made of thermoplastic material for the latch bolt with a stop leg for the latch bolt and a cushioning leg for the catch. A spring lip may be integrally molded on the stop leg.

Finally, DE 20 2008 012 010 U1 discloses a spring-loaded limiter for a latch bracket or latch bolt for a motor vehicle lock, which is primarily described as a locking part. Said spring-loaded limiter is formed by a torsion spring. A spring arm of the torsion spring supports a plastic spring tongue formed as a single part with the lock housing. In the closed position, the spring tongue is received while being pretensioned at one side by a receiving portion of the locking part and is received at the other side by an arm of the catch.

Although such a conventional lock certainly ensures sufficient noise attenuation when the door or hatch is shut, when the motor vehicle is in motion, creaking noises cannot be eliminated as they arise in the closed position of the lock due to the relative motion of the lock housing or the catch with respect to the latch bracket or latch bolt, or due to the preferred choice of materials. Specifically, the spring tongue is made of plastic, as mentioned above, whereas the locking bracket or locking bolt is made of metal, especially steel. Such a pairing of materials causes creaking noises, associated with the stick-slip effect, due to unavoidable accumulation of dirt, and especially due to the corresponding frictional surfaces becoming covered with dust. The invention described below was made in this context.

BRIEF DESCRIPTION OF THE INVENTION

It is one objective of the invention to improve a lock such that said noises, especially creaking noises that arise in the closed position of the lock due to relative motion of the lock housing or the catch with respect to the latch bracket or latch bolt, are avoided or at least significantly reduced.

The invention includes the selection of a pair of materials from which frictional counterparts are made, i.e., the latch bracket or latch bolt and the spring lip, such that the above-mentioned stick-slip effects are avoided to the greatest possible extent.

The objective of the invention is realized by providing a lock for a motor vehicle door or hatch with a lock housing attached to the vehicle door or hatch, preferably of plastic, to which is attached a catch, and with a latch bracket or latch bolt attached to the vehicle body, preferably made of metal, which in a closed position of the door or hatch is received by the catch at least in a positively-fitting manner, wherein the lock housing is provided with a guide groove for the latch bracket or latch bolt and at least one spring lip at the entrance side of the guide groove that extends longitudinally therein for elastically supporting the latch bracket or latch bolt in the closed position of the lock as well as during insertion of the latch bracket or latch bolt into and refraction out of the guide groove and the catch, and wherein at least one said spring lip, at least in a region of its free end, which free end corresponds to an end position and a support position of the latch bracket or latch bolt in the closed position of the lock, comprises an overlay of a low-friction, wear-resistant surface, whereby said stick-slip effects are preferably avoided and the ride comfort is improved for the vehicle occupants relative to the related art.

The dependent claims describe preferred embodiments and further variants of the invention.

According to a simple and inexpensive design feature, said overlay can be formed at least as a plate element or profile element with a low-friction wear-resistant surface, which plate element or profile element is rigidly connected to the spring lip in a form-locking, force-fitting, and/or material-bonded manner. The plate element or profile element may be made of metal, plastic, ceramic, or any other suitable material having a low-friction and wear-resistant surface.

Advantageously, the plate element or profile element may be formed as a separately-produced part that is inexpensively prefabricated and rigidly attached to the spring lip during assembly of the lock. In contrast, however, it may also be appropriate to integrate the plate element or profile element into the spring lip made of plastic during production of the lock housing, thereby resulting in savings during installation of the lock. In certain embodiments in which the overlay is chosen to be in the form of a profile element, the profile element can be preferably formed as a hollow section having an open or closed cross-section with at least one profile wall that comes into contact with the latch bracket or latch bolt. In this way, the attachment of the overlay to the spring lip is comfortably realized.

Further advantage can be provided by a surface treatment of the low-friction, wear-resistant surface of the plate element or profile element to reduce surface roughness, by friction coating, e.g., electrolytic coating with a low-friction and wear-resistant material and/or by any other suitable type of coating with a low-friction and wear-resistant material. As a result of extensive experiments, it has proven particularly advantageous to use a plate element or profile element of steel, especially stainless steel, because it can be inexpensively manufactured.

To avoid unwanted closing sounds, the spring lip is preferably formed and connected to the plate element or profile element such that at least the surfaces that come into contact with the latch bracket or latch bolt form a smooth contact both with the spring lip as well as with the plate element or profile element. In a further advantageous embodiment of the invention, the spring lip is formed integrally with the lock housing due to economic and manufacturing reasons.

BRIEF DESCRIPTION OF THE DRAWINGS

The invention is explained in more detail hereinbelow with reference to the accompanying drawings schematically showing an exemplary embodiment, in which.

DETAILED DESCRIPTION OF THE INVENTION

Figure 1:
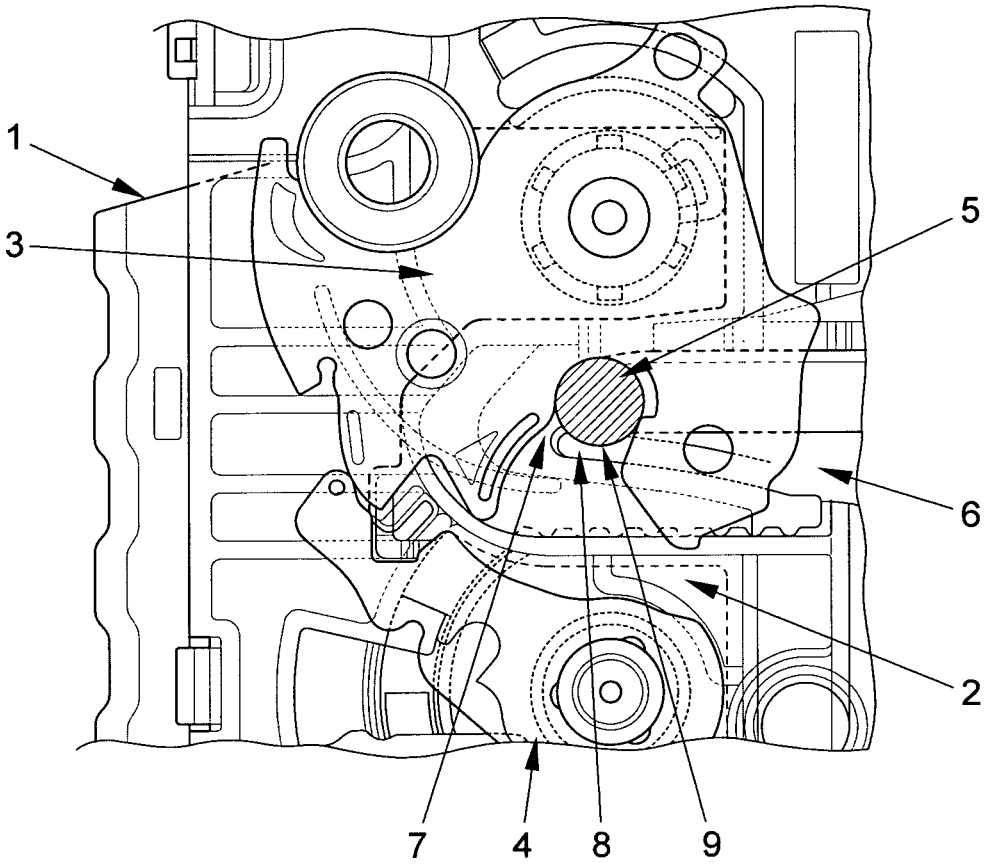
FIG. 1 shows a sectional side view of a lock for a motor vehicle door or hatch according to the related art.
Figure 2:
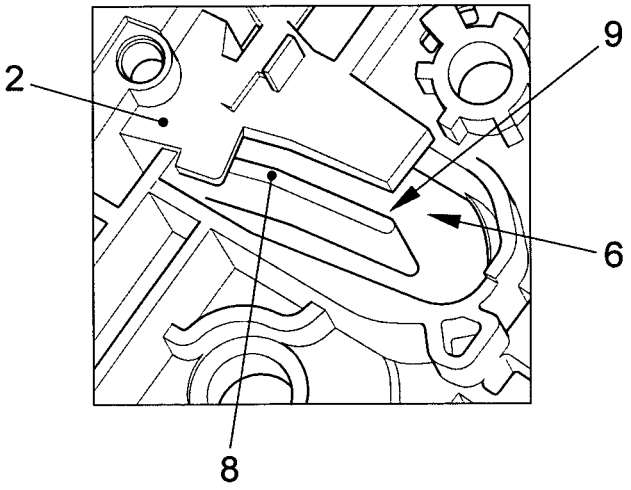
FIG. 2 shows a perspective view (rotated by 180 degrees about a vertical axis) of the lock housing of the lock shown in FIG. 1 only.

FIGS. 1 and 2 show in a highly schematic representation a lock for a motor vehicle door 1, with a lock housing 2 attached to the vehicle door, and a catch 3 rotatably attached to the lock housing 2.

The invention is not limited to be applied to the door 1, but extends to any known motor vehicle hatch (not shown) that can be locked or lockable by means of the inventive lock.

The catch 3 interacts with a pawl 4, known per se, and is shown with respect to the lock primarily in the closed position of the door, wherein a latch bracket 5, known per se and attached to the vehicle body, which can also take the form of a latch bolt (not-shown), is received by the catch at least in a form-locking manner. During the closing operation, the latch bracket 5 is guided within a guide slot 6 of the lock housing 2 and eventually received by the inlet 7 of the catch 3.

At least one spring lip 8, longitudinally reaching into, i.e., projecting into the guide slot 6, is affixed to the lock housing 2 at the entrance side to the guide slot 6. The spring lip 8 elastically supports the latch bracket 5 in the closed position of the lock as well as during insertion of the latch bracket 5 into and retraction of the latch bracket 5 out of the guide slot 6 and out of the inlet 7 of the catch at the lock housing 2. As already stated in the introduction, the spring lip 8 results in an advantageous damping of closing and rattling noises, in particular.

The lock housing 2 is made of plastic, preferably of a thermoplastic, and is injection-molded as a single part in conjunction with the spring lip 8 using known processes. The latch bracket 5 comprises mainly stainless steel.

Such a combination of materials, however, causes unpleasant creaking noises associated with the known stick-slip effect, due to unavoidable accumulation of dirt, and especially due to the corresponding frictional surfaces becoming covered with dust.

Figure 3:
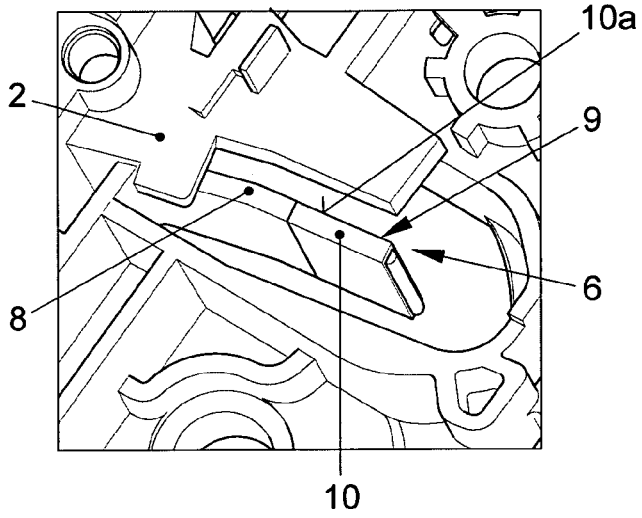
FIG. 3 is a perspective view of the lock housing only, which comprises a spring lip with the inventive overlay.

To counter these adverse circumstances, the spring lip 8 comprises at least in the area of its free end, which corresponds to the end position and the support position 9 of the latch bracket 5 in the closed position of the lock (compare especially FIG. 1), an overlay 10 having a low-friction, wear-resistant surface (FIG. 3).

In this embodiment, the overlay 10 is implemented by a profile element rigidly connected to the spring lip 8, which profile element is a separately-produced part having a hollow, closed cross-section in the nature of a box profile, which is axially impaled onto an appropriately prepared free end of the spring lip 8 and circumferentially surrounds the same.

Said overlay 10 has the form of a box profile preferably made of a stainless steel and comprises means for interlocking, formed as a single piece with the overlay 10. The means for interlocking have the form of single or multiple interlocking teeth made of plastic, which penetrate during the pushing together of the overlay 10 onto the spring lip 8 into the same and form a tight fit with the same.

The profile wall 10*a* of the overlay 10 which comes into contact with the latch bracket 5 comprises a low-friction, wear-resistant surface, which is surface-treated to yield as low as possible surface roughness, e.g., by introducing an additional layer of friction coating by electrolytically coating with a low-friction, wear-resistant material and/or by any other suitable type of coating with a low-friction and wear-resistant material.

Figure 4:
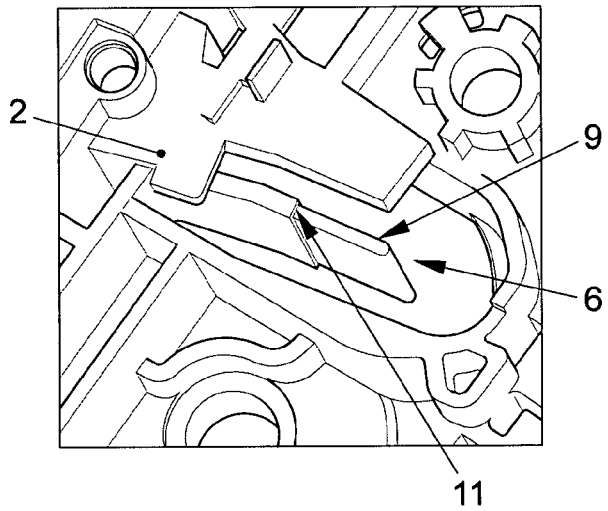
FIG. 4 is a perspective view of the lock housing only, which is prepared for application of said overlay.
Figure 5:
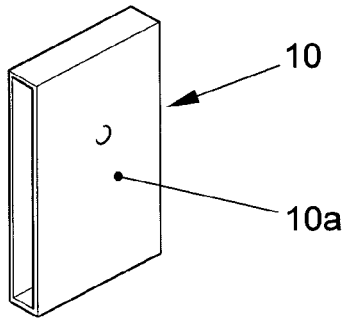
FIG. 5 shows a preferred embodiment of said overlay in a single part view.

As shown particularly in FIG. 4, the region of the spring lip 8, which corresponds to the end position and the support position 9 of the latch bracket 5 in a closed position of the lock, comprises at its free end a ledge 11, to which a section of the free end of the spring lip 8 having a reduced material thickness is joined.

The overlay 10 is fixed to this section. At the same time, the ledge 11 is selected at least such that the surfaces that come into contact with the latch bracket 5 form a step-free contact with both the spring lip 8 and the overlay 10, which is in a form of a box-shaped profile.

In the aforementioned preferred embodiment, the stainless steel overlay 10 having a box-shaped profile in its cross-section is connected in a form-locking manner to the free end of the spring lip 8.

The invention is not limited to this embodiment, however, but also encompasses other versions of the overlay 10, which are within an easy reach to a skilled artisan, and thus are not described in more detail herein. Such overlays 10 may be formed as a plate or a hollow profile that has an open cross-section. Furthermore, the overlays 10 can be rigidly connected to the spring lip 8 in a force-fitting manner or by bonding, e.g., gluing. Furthermore, it may also be appropriate to make the overlay 10 from a material other than stainless steel that is sufficiently low in friction and high in wear resistance, e.g., a plastic or a ceramic material, as claimed in the appended claims. It may also prove advantageous to integrate the overlay 10 with the spring lip 8, wherein the overlay 10 is expediently injection-molded out of plastic together with the spring lip 8 during production of the lock housing 2 such that the number of production steps is reduced during the assembly or mounting of the lock and all of its components.

REFERENCE LIST

1. Door
2. Lock housing
3. Catch
4. Pawl
5. Latch bracket
6. Guide slot
7. Inlet of the catch
8. Spring lip
9. End position and supporting position of the latch bracket 5 in the closed position of the lock
10. Overlay
10*a*. Profile wall
11. Ledge

The invention claimed is:

1. A lock for a motor vehicle door or hatch comprising: a lock housing attached to the vehicle door or hatch, to which is rotatably attached a catch, and with a latch bracket or latch bolt attached to a vehicle body, which in a closed position of the door or hatch is received by said catch at least in a positively-fitting manner, wherein said lock housing is provided with a guide slot for said latch bracket or latch bolt and at least one spring lip at an entrance side of said guide slot extending longitudinally therein for elastically supporting said latch bracket or latch bolt in said closed position of the lock as well as during insertion of said latch bracket or latch bolt into and retraction of said latch bracket or latch bolt out of said guide slot and said catch, and wherein the at least one said spring lip has a free end and the free end corresponds to an end supportive position of said latch bracket or latch bolt in said closed position of the lock, and the free end features an overlay having a low-friction, wear-resistant surface;

wherein said overlay is a plate element or profile element having a low-friction, wear-resistant surface, and wherein said plate element or said profile element is rigidly connected to said at least one spring lip in a form-locking, force-fitting, and/or material-bonded manner; and wherein the overlay has a hollow box profile having an open cross-section in a first direction and a closed cross-section in a second direction, and wherein said profile comprises a profile wall adapted to come into contact with said latch bracket or said latch bolt.

2. The lock of claim 1, wherein said plate element or said profile element is a metal, a plastic, a ceramic, or any other suitable material having a low friction and wear-resistant surface.

3. The lock of claim 1, wherein said plate element or said profile element is a separate ad-on part.

4. The lock of claim 1, wherein said plate element or said profile element is integrated as a single part with said at least one spring lip, and said single part is formed during production of said lock housing.

5. The lock of claim 1, wherein said low-friction, wear-resistant surface of said plate element or said profile element is surface-treated to yield as low as possible surface roughness, by introducing a friction coating by electrolytically coating with a low-friction, wear-resistant material and/or by any other suitable type of coating with a low-friction and wear-resistant material.

6. The lock of claim 1, wherein said plate element or said profile element is a steel metal, and particularly stainless steel.

7. The lock of claim 1, wherein said at least one spring lip is implemented such and said plate element or said profile element is attached to said at least one spring lip such that surfaces that come into contact with said latch bracket or said latch bolt form a step-free connection with both said at least one spring lip and said plate element or said profile element.

8. The lock of claim 1, wherein said at least one spring lip and said lock housing are a single piece.

9. The lock of claim 2, wherein said plate element or said profile element is a separate ad-on part.

10. The lock of claim 2, wherein said plate element or said profile element is integrated as a single part with said at least one spring lip, and said single part is formed during production of said lock housing.

11. The lock of claim 2, wherein said low-friction, wear-resistant surface of said plate element or said profile element is surface-treated to yield as low as possible surface roughness, by introducing a friction coating by electrolytically coating with a low-friction, wear-resistant material and/or by any other suitable type of coating with a low-friction and wear-resistant material.

12. The lock of claim 3, wherein said low-friction, wear-resistant surface of said plate element or said profile element is surface-treated to yield as low as possible surface roughness, by introducing a friction coating by electrolytically coating with a low-friction, wear-resistant material and/or by any other suitable type of coating with a low-friction and wear-resistant material.

13. The lock of claim 4, wherein said low-friction, wear-resistant surface of said plate element or said profile element is surface-treated to yield as low as possible surface roughness, by introducing a friction coating by electrolytically coating with a low-friction, wear-resistant material and/or by any other suitable type of coating with a low-friction and wear-resistant material.

14. A lock for a motor vehicle door or hatch comprising: a lock housing attached to the vehicle door or hatch, to which is rotatably attached a catch, and with a latch bracket or latch bolt attached to a vehicle body, which in a closed position of the door or hatch is received by said catch at least in a positively-fitting manner, wherein said lock housing is provided with a guide slot for said latch bracket or latch bolt and at least one spring lip at an entrance side of said guide slot extending longitudinally therein for elastically supporting said latch bracket or latch bolt in said closed position of the lock as well as during insertion of said latch bracket or latch bolt into and retraction of said latch bracket or latch bolt out of said guide slot and said catch, and wherein the at least one said spring lip has a free end and the free end corresponds to an end supportive position of said latch bracket or latch bolt in said closed position of the lock, and the free end features an overlay having a low-friction, wear-resistant surface; wherein said overlay is a plate element or profile element having a low-friction, wear-resistant surface, and wherein said plate element or said profile element is rigidly connected to said at least one spring lip in a form-locking, force-fitting, and/or material-bonded manner; wherein said plate element or said profile element is a metal, a plastic, a ceramic, or any other suitable material having a low friction and wear-resistant surface; wherein said plate element or said profile element is integrated as a single part with said at least one spring lip, and said single part is formed during production of said lock housing; wherein said overlay has a hollow box profile having an open cross-section in a first direction and a closed cross-section in a second direction, and wherein said profile comprises a profile wall adapted to come into contact with said latch bracket or said latch bolt; wherein said low-friction, wear-resistant surface of said plate element or said profile element is surface-treated to yield as low as possible surface roughness, by introducing a friction coating by electrolytically coating with a low-friction, wear-resistant material and/or by any other suitable type of coating with a low-friction and wear-resistant material; and wherein said at least one spring lip is implemented such and said plate element or said profile element is attached to said at least one spring lip such that surfaces that come into contact with said latch bracket or said latch bolt form a step-free connection with both said at least one spring lip and said plate element or said profile element.

* * * * *